US005499582A

United States Patent [19]

Schiessl et al.

[11] Patent Number: 5,499,582

[45] **Date of Patent: * Mar. 19, 1996**

[54] PROJECTILE

[75] Inventors: Alois Schiessl; Wolfgang Steinicke, both of Marzoll; Wolfgang Trede, Weil am Rhein; Hartmut Krone, Auggen, all of Germany

[73] Assignee: Buck Chemische-Technische Werke GmbH & Co., Bad Reichenhall, Germany

[ * ] Notice: The portion of the term of this patent subsequent to Aug. 29, 2006, has been disclaimed.

[21] Appl. No.: 23,526

[22] Filed: Mar. 8, 1979

[30] Foreign Application Priority Data

Mar. 14, 1978 [DE] Germany ..... 28 11 016.9

[51] Int. Cl.[6] ..... F42B 12/48

[52] U.S. Cl. ..... 102/334; 102/285; 102/505

[58] Field of Search ..... 102/6, 66, 60, 102/87, 90, 34.6, 37.6, 36.7, 493, 49.1, 89 C, 89 D, 99–103, 334, 364, 367, 505, 374, 351, 357, 342, 283–290

[56] References Cited

U.S. PATENT DOCUMENTS

| | | | |
|---|---|---|---|
| 3,324,794 | 6/1967 | Gahle | 102/334 |
| 3,617,403 | 11/1971 | Johnson | 149/19 |
| 3,674,174 | 7/1972 | Crewe | 343/18 B |
| 3,720,167 | 3/1973 | Mainhardt | 102/89 CD |
| 3,862,601 | 1/1975 | Rentsch et al. | 102/49.3 |
| 3,960,087 | 6/1976 | Beatty et al. | 102/90 |
| 4,838,167 | 6/1989 | Prahauser et al. | 102/334 |
| 4,860,657 | 8/1989 | Steinicke et al. | 102/334 |

FOREIGN PATENT DOCUMENTS

| | | | |
|---|---|---|---|
| 1100507 | 9/1961 | Germany . | |
| 1157115 | 11/1963 | Germany . | |
| 1185510 | 9/1965 | Germany . | |
| 1428657 | 9/1969 | Germany | 102/334 |
| 1913790 | 10/1970 | Germany . | |
| 1254510 | 4/1972 | Germany . | |
| 2614196 | 10/1977 | Germany | 102/334 |
| 2809497 | 9/1978 | Germany . | |
| 1573645 | 8/1980 | United Kingdom | 102/334 |

OTHER PUBLICATIONS

Technik Und Versorgung, 1970, pp. 63–68.

*Primary Examiner*—Harold J. Tudor
*Attorney, Agent, or Firm*—Anderson Kill Olick & Oshinsky

[57] ABSTRACT

A projectile is described which consists of a contact head and a screen material canister which may be made of aluminum, attached thereto by bolts and, optionally closed with a cover. Contact rings are arranged on an outer casing of the contact head and are connected via firing leads to a primer capsule which is located in the contact head in a centrally disposed box-shaped charge chamber having a substantially gas-tight screw cover at its base and substantially gas-tight ports for the firing leads, the ports being sealed with a sealing agent. A delayed action fuse assembly is arranged in the head section of the contact head or in the base of the screen material canister and connects the charge chamber and the canister, the assembly being in communication with the canister either through an igniter-destructor unit having a charge for igniting the screen material and fragmenting a casing of the canister, or through an expelling charge chamber containing an expelling charge for expulsion of the screen material at rupture of the cover on the head of the canister. The screw cover is formed at its edge with a screw thread and is formed at least in its central region with an abutment for a spacer of a cup discharger, the parts of the cover between the edge and the abutment being formed with weakened areas for the escape of propellent gases. The screen material may consist of thin combustible lamellae which may comprise a carrier material carrying a slow-burning combustion layer.

23 Claims, 4 Drawing Sheets

PROJECTILE

Figure 1:
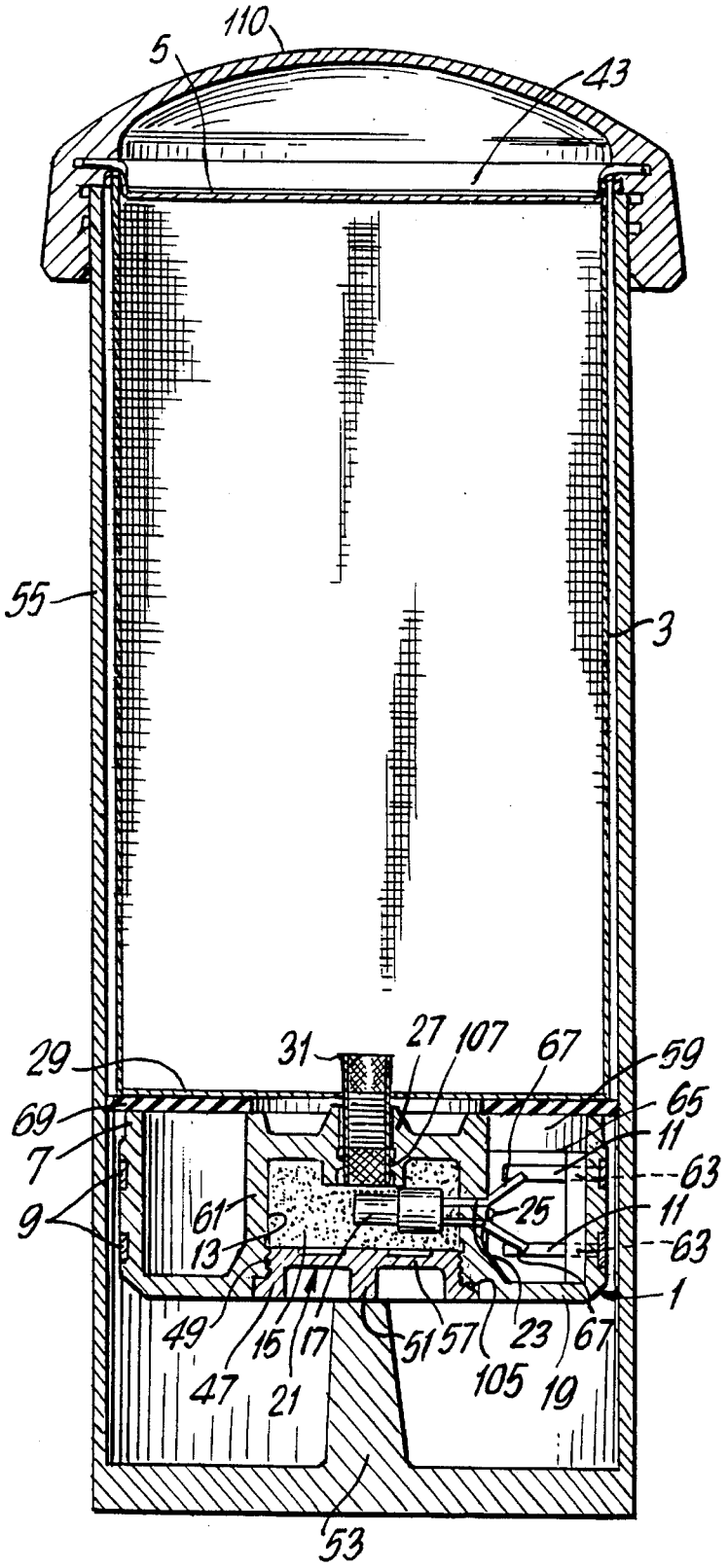

The subject of the invention is a projectile consisting of a contact head and attached thereto a screen material canister, closed if need be with a cover, on the outer casing of the contact head being arranged contact rings, which via firing leads are connected with a primer capsule within the contact head disposed within a box-shaped charge chamber for the accommodation of the propellant charge, the charge chamber being practically gastight, towards the external space at the basal part of the contact head by virtue of a screw cover and at the ports for the firing leads by virtue of a sealing agent, in the head section of the contact head or in the base of the screen material canister as connection between the charge chamber and the screen material canister being arranged gastightly towards the external space a delayed action fuse assembly, which stands in communication within the screen material canister with an igniter-destructor unit with an igniter-destructor charge for igniting the screen material and fragmenting the casing of the screen material canister or with an expelling charge chamber with an expelling charge for expulsion of the screen material at rupture of the cover present on the head of the screen material canister, and both the contact head and the screen material canister being firmly connected with one another by bolts.

Projectiles, which in essence consist of a screen material canister, which is filled with a certain screen material, for example a smoke charge, and standing in contact with it via a delay fuse assembly a contact head, in which an electrically firable propellant charge for expulsion of the entire projectile from a cup discharger and for firing the delayed action fuse assembly or a manually operated friction igniter are arranged, are already known. In this connection by way of example reference is made to DE-PS 11 85 510 and 14 28 657.

Moreover projectiles are also already known, which as screen or counter-measure material contain chaff or infrared flares and which in general are launched from ships, in order to protect these ships from enemy cruise missiles.

The chaff projectiles are in this so designed, to produce in a very short time, for example within 5 seconds, at a given height above sea level, for example at a height of from 40 to 60 m, a chaff cloud of large area, for example with a surface of above 300 $m^2$, which represents a radar reflection surface and consequently a radar cross-section, which forms a deception for enemy target-homing equipment.

The infrared flare projectiles contain as deception or decoy an infrared flare, which after ejection of the flare is ignited by means of a flare fuse and suspended by parachute. The infrared flare radiates a quantity of heat energy which normally lies above that of the energy radiated from the object to be protected. Hereby for example missiles responding to infrared radiation are decoyed and deceived. Infrared flares suitable for this purpose or other infrared radiation emitting bodies should have the longest possible combustion times, for example minimum combustion times of 40 seconds, and in addition should sink as slowly as possible, should show for example a rate of sinking of less than 2 m per second.

There are moreover already combinations of chaff projectiles and infrared flare projectiles, by which an infrared flare is suspended in a chaff cloud. Such combinations produce naturally a simultaneous radar interference and infrared interference.

Devices of the above-mentioned type are mentioned in Wehrtechnik 5, 1975, page 217, International Defence Review 2, 1976, pages 217 to 220 and International Defence Review 3, 1977, page 500. In U.S. Pat. No. 3,674,174 is described for example a special device for dispersing pyrotechnic lamellae, smoke canisters or radar-reflecting materials.

The known projectiles, which are fired from appropriate cup dischargers, have however unfortunately a series of disadvantages which make them of only limited applicability.

One of these disadvantages consists in the fact, that the screen material canister of this projectile usually takes the form of a can made of metal plate which consequently shows a flanged longitudinal rim and its base therefore in like manner must be secured by flanges. As a result of the lateral flange however no clean fit of the screen material canister to the respective cup discharger is achievable, and analogous considerations apply also to the likewise flanged base, in this base in addition a separate bracket plate being absolutely necessary, by means of which the screen material canister can be firmly connected with the contact head and in which further requisite devices, for example support or attachment members for respective charges, can be accommodated. The production of such a screen material canister is consequently not only expensive, but also associated with further disadvantages. The lack of a clear, and hence too ever varying accuracy of, fit of the screen material canister in the cups discharger conditioned by the lateral flange constantly necessitates namely a certain, never exactly reproducible, annular clearance between the outer surface of the casing of the screen material canister and the inner surface of the cup discharger, so that on firing such a screen material canister there always escapes a certain quantity, the more uncontrollable because of variations in the dimensions of the annular clearance, of the combustion gases, which on firing the propellant charge situated in the charge chamber in the contact head provides for the propulsion of the screen material canister from the cup discharger. A loss of propellant energy results from the design-conditioned annular clearance. The likewise design-conditioned imprecise adjustability of this annular clearance however also entails the far more serious disadvantage, that the height of firing for the individual screen material canister is dependent on the annular clearance and thus not clearly reproducible in every case. Different screen material canisters therefore under otherwise fully identical conditions result in different firing heights.

Special disadvantages of the known projectiles also result from the design of the contact head specific to them. Thus for example the contact rings are not sufficiently oxidation proof, as a result of which moreover the connecting leads between these contact rings and the primer capsule situated in the interior of the contact head and connected with the charge chamber for the propellant charge do not permit a proper seal against the atmosphere. Failures result increasingly from this through failure of the firing mechanism with in addition only limited storage stability of the projective as such or in the respective cup discharger. A further grave disadvantage of projectiles of known design is attributable to the fact, that in these the charge chamber projects from the base of the contact head and furthermore is eccentrically disposed. This is conditioned by the fact, that the usual projectiles also contain additionally in the base of the contact head a friction igniter for manual firing which is likewise projecting in form. Both elements can only be accommodated together eccentrically. On the unoccupied central region of the base section of such a contact head the spacer present on the base of the cup discharger must in addition be able to lie, so that in every case precise disposition of the contact rings on the spring contacts of the cup discharger is guaranteed. This function in the known devices cannot be fulfilled either because of the projecting charge chamber or because of the friction igniter. The eccentric arrangement of the charge chamber for the propellant charge in the contact head gives moreover the further disadvantage, that the combustion gases cannot immediately exert their effect in the centre of the cup discharger, but only laterally to it, which leads to spin and hence to variable range of the screen material canister. A central arrangement of the charge chamber in the contact head however, even if the friction igniter in devices of this sort were left out altogether, would not be possible because of the existing special construction of such chambers. The eccentric arrangement of the charge chamber entails the further disadvantage, that only by expensive designs can central devices be incorporated, which have to be in communication with the charge chamber via the delayed action fuse assembly.

The completely different design of the known projectiles, especially in respect of the screen material canister and the contact head, inevitably entails, that these projectiles are not suitable for dispensing combustible thin lamellae (flares) or chaff (thin metal wires). For this purpose therefore one has until now had to fall back on relatively expensive designs. Even these however afford no completely satisfactorily tidy and effective formation of suitable chaff clouds.

All known simple projectiles by virtue of the design faults described above have in addition the further disadvantage, that they are not resistant in the requisite degree against the influence of sea water and the extreme atmospheric influences conditioned by this.

The afore-mentioned disadvantages limit the possibilities of application of the known projectiles very greatly, and the invention therefore had as its task, the creation of a new projectile, which did not show these disadvantages.

The task was solved with the projectile mentioned at the beginning, which is characterised in that, the charge chamber in the contact head is centrally arranged and provided with a screw cover with gastight closure showing a thread at its massive edge, which cover is formed at least in its central area to a massive abutment for a spacer of a cup discharger, the parts of the cover between the edge and the abutment being formed as window-like preset breaking points for the escape of the propellant gases.

The contact head and its incorporated screw cover are expediently appropriately moulded shapes, which are best produced by injection moulding of suitable plastics, such as polystyrene.

The abutment present in the screw cover for the charge chamber of the contact head is expediently developed in the form of a cross-piece extending from edge to edge of the cover. The cross-piece so formed is a massive abutment for the spacer of the cup discharger and at the same time also a hand-grip for screwing in the screw cover into the centrally disposed charge chamber in the base of the contact head. Around the massive edge of the screw cover a packing ring is preferably arranged, which gives a gastight closure of the charge chamber.

At least the part of the firing leads present on the contact rings consists preferably of connecting pins reaching at least through the outer casing of the contact head into the inner space between the outer casing of the contact head and the casing of the charge chamber, which pins are soldered onto the inner surface of the contact rings. At least a part of the connecting pins together with the parts of the contact rings turned towards the outer casing of the contact head is preferably cast integrally with the outer casing of the contact head. At the same time the part of the outer casing of the contact head bearing the connecting pins in the inner space between the outer casing of the contact head and the casing of the charge chamber is further preferably developed at least in part as a cross-piece. The surface of the connecting pins is expediently knurled, and the connecting pins themselves are preferably profiled, best having a four-cornered profile, by which an especially good and tight seating of the connecting pins in the material of the contact head is guaranteed. The utilization of suitable contact rings with connecting pins ready soldered on in injection moulding of the basic substance of the contact head gives the same advantage, namely a clean and tight fit of these structural elements in the contact head. The connecting pins reach expediently only to the inner space between the outer casing of the contact head and the casing of the charge chamber, and they are then connected via conducting wires disposed in ports in the casing of the charge chamber with the primer capsule situated in the charge chamber, the charge chamber being closed gastight towards the inner space of the contact head at the respective ports with a sealing compound. The cross-piece containing the connecting pins in the inner space between the outer casing of the contact head and the charge chamber is consequently so developed, that in this internal space it leaves free at least one side of the connecting pins, on to which the respective conducting wires to the primer capsule situated in the charge chamber can be soldered. On the outer surface of the contact head there are thus no soldered joints or connections of any sort, which are exposed to attack by the ambient atmosphere. The connecting pins and the attached contact rings are preferably produced in brass. For protection against corrosion these parts are in addition expediently gilded.

In the head section of the contact head a delayed action fuse assembly is centrally disposed, which establishes the connection between the charge chamber in the basal part of the contact head and the base of the screen material canister, and consequently an igniter-destructor unit or expelling charge chamber arranged within. The delayed action fuse assembly is expediently screwed into the head part of the contact head, and for this purpose there is also additionally present best centrally inserted a suitable threaded tube. Further there are disposed in the contact head around the charge chamber at least two boreholes to receive the bolts for connecting the contact head with the screen material canister, which expediently are so developed, that the bolt-heads are fully countersunk within them and they can be closed flush with the basal part of the contact head with suitable covers. The boreholes in the contact head for receiving the bolts are likewise best formed simultaneously with the forming of the contact head. The upper part of the outer casing of the contact head is otherwise preferably so developed, that in the connection with the base of the screen material canister and an intervening sealing member it makes thorough sealing between both elements possible. For this purpose it is best designed with fluting. Between the casing of the charge chamber disposed centrally in the contact head and the outer casing of the contact head connecting cross-pieces are preferably present for reciprocal stabilisation.

In a specially prefered constructional form of the projectile in question the sealing interposed between the contact head and the screen materials canister has the form of a projecting sealing washer, the outside diameter of which corresponds at least to the interior diameter of the discharger cup. This sealing washer produces on the one hand a tight closure between the contact head and the discharger cup and on the other prevents the possible escape of the combustion gases formed on firing the propellant charge present in the contact head by way of the annular clearance, even if only minimal, between the casing of the screen material canister and the inner wall of the discharger cup. Furthermore by virtue of the flexibility of the sealing washer dimensional tolerances between the cup discharger and the screen material canister will be compensated. In this way a constantly equal tamping of the propellant charge and hence reproducible firing ranges is provided for. The sealing washer is preferably produced of oil-resistant nitrile rubber.

In addition in the base of the screen material canister there is expediently disposed a fastening plate, by means of which the screen material canister can be firmly bolted to the contact head, and which in case of need may also by appropriate further development accomplish other functions, which are requisite for the mode of operation of projectiles of this sort. Thus for example igniter-destructor units or expelling charge chambers can be arranged on this fastening plate. In an especially preferred constructional form however the strengthened base of the screen material canister is designed as a fastening plate, so that a separate fastening plate may be omitted. If a screen material canister with separate fastening plate on its base is used, then between this fastening plate and the actual base of the screen material canister an additional sealing for example a packing ring, is arranged, which provides for a gastight connection of both elements. This strengthened development of the base of the screen material canister as fastening plate is rendered possible by virtue of the fact, that the screen material canister consists of a quite special preferred constructional form of a thin-walled drawn aluminium container, in the manufacture of which by drawing the base of the screen material canister can be simply formed already strengthened as a fastening plate. Precisely the application of aluminium as construction material for the production of the screen material canister makes possible the fully seamless construction of such a canister the the special advantages associated with this. The thickness of the casing of the screen material canister in a particular case is adapted to the intended special function in that particular case. The screen material canister is normally closed at its head with a cover, which likewise preferably consists of aluminium and which is flanged with the head of the aluminium container. In accordance with the application of the projectile the wall thickness of the aluminium container is so designed, that the casing after ignition of a charge present in the screen material canister either tears apart without ejection of the flanged cover, so that the wall of the screen material canister is fragmented, as would be desirable for example with a screen material consisting of combustible thin lamellae (flares), there then being arranged centrally within the screen material canister a suitable igniter-destructor unit consisting of a tube filled with an igniter-destructor charge, or the wall of the aluminium container serving as screen material canister may also be so thick, that the casing at the firing of a charge present in the screen material canister does not tear apart, but the cover on the head is alone torn off, so that the screen material is discharged via the head of the screen material canister. In the last-named case an expelling charge chamber with a suitable expelling charge is arranged in the base of the screen material canister, which in association with the appropriate devices ensures, that the screen material, we are here concerned preferentially with chaff, is discharged after the cover has been torn off via the head of the screen material container. With suitable provisions however a single aluminium container can be utilized for both purposes, the wall thickness of which is identical in each case and amounts for example to 0.25 mm. Thus it is always a question of an aluminium container, which provides for the requisite defined tamping.

According to the proposed function of the projectile in question two further, in accordance with the invention particularly preferred constructional forms of this projectile may accordingly be produced.

In the first constructional form of such kind the screen material container contains an igniter-destructor unit with an igniter-destructor charge for igniting the screen material present in the screen material canister and/or destroying the wall of the screen material canister, this igniter-destructor charge in this case standing, in contact via the delayed action fuse assembly with the propellant charge in the charge chamber and fired by the latter via the delayed action fuse assembly. The igniter-destructor unit consists preferentially of a tube filled with an igniter-destructor charge, which is disposed centrally in the fastening plate or in the base of the screen material canister developed as a fastening plate. Preferentially this igniter-destructor unit extends practically to the cover of the screen material canister. The tube of the igniter-destructor unit consists moreover just like the screen material canister at best likewise of aluminium and has for example a wall thickness of 0.25 mm. The utilization of aluminium as construction material for the tube of the igniter-destructor unit and the screen material canister as well as the cover of the screen material canister confers in addition to the advantage of ease of fabrication of articles of such type the further advantage, that these materials possess the corrosion resistance and compatibility with the majority of pyrotechnic ingredients desirable in such equipment, so that a special protection against corrosion can be dispensed with. At the same time the aluminium used here as construction material may burn together with the respective charge. Further drawn sleeves of such type as a consequence of the absence over their entire periphery of sutures possess uniform physical properties, which ensures particularly good reproducibly of function of the corresponding projectiles, and such tubes finally can also be manufactured with precisely reproducible inner and outer diameters.

The tube of the igniter-destructor unit filled with the igniter-destructor charge is self-evidently appropriately tightly fitted in the base of the screen material canister, and hence in the fastening plate, and connected with the delayed action fuse assembly. This is preferentially brought about, by the open end of the tube of the igniter-destructor unit standing in contact with the delayed action fuse assembly showing a flanged edge, by means of which the tube is screwed from below in a gastight manner into the screen material canister and the fastening plate or into the base of the screen material canister developed as a fastening plate. In this connection the open end of the tube is expediently connected by flanging with a cover plate and via this with the aid of a lock screw together with a ring packing is screwed gastight from below into the screen material canister and the fastening plate or into the base of the screen material canister developed as a fastening plate. The desired gastight connection is achieved by means of a ring packing, which on screwing together the three distinct elements is pressed thereon, namely onto the fastening plate or onto the base of the screen material canister developed as a fastening plate, onto the cover plate and on to the tube. The drilled hole in the cover plate is expediently sealed gastight by gluing on a piece of foil, preferentially tin foil.

A projectile with the just mentioned organisation of the interior of the screen material canister is especially suited for filling with a screen material of combustible thin lamellae (flares) or for filling with a screen material consisting of a single pressed body of reactive material, above all of a pressed body produced by pressing pellets consisting of a smoke charge with a base of red phosphorus and a granulate consisting of a smoke charge with a base of red phosphorus.

Particularly favoured is a filling of the interior of the screen material canister with a combination of combustible thin lamellae and a single pressed body as screen material, so that a certain part of the screen material canister is filled with combustible thin lamellae and the remaining part is provided with a single pressed body of the aforesaid type.

The combustible thin lamellae utilised as screen material for filling concern preferentially circular-sector-shaped lamellae, which in particular have the form of a circular sector with an angle of approximately 120°. Precisely this last-need shaping of the circular-sector-shaped lamellae ensures, that the lamellae after their ignition and discharge from the screen material canister produce a properly distributed cloud of material with a suitably slow and regular rate of sinking. Furthermore lamellae of such form can be tidily packed in the box-shaped screen material canister.

The circular-sector-shaped lamellae, dependent merely on their special shape, are arranged radially in the screen material canister around the igniter-destructor unit. They consist of a suitable carrier material with a slow-burning combustion layer of a combustible paste applied to at least one side, this combustion layer of combustible paste however being preferentially bilaterally applied.

The carrier material used for the production of the combustible thin lamellae may consist for example of paper, of a metal foil, like an aluminium foil, of a plastic foil or of a metal-coated plastic foil. The weight per unit area of such carrier material may reach about 60 g/m$^2$. The utilization of ordinary paper as carrier material for the production of combustible thin lamellae is at present preferred, since this material can be readily provided with the requisite combustion layer of combustible paste and other materials, is good for processing and finally it is also cheap. Paper with a weight per unit area of from 30 to 35 g/m$^2$ is particularly favoured for this.

The combustion layer of combustible paste present on the thin lamellae respectively actual carrier material should in general be relatively easily ignitable, which is effected by means of the igniter-destructor unit which is centrally arranged in the screen material canister, but then on the other hand they should not burn up too quickly, so that the desired and requisite longer lasting infrared radiation results. As coating substances for application of the appropriate combustion layer of combustible paste to the thin carrier materials practically all ignitable and combustible pastes, which fulfil these conditions, are suitable.

For the formation of suitable combustion layers of combustible paste above all red phosphorus and in particular boron have proved themselves suitable. However as phosphorus and boron in respect of their ignitability and their combustion by virtue of different activities, phosphorus, as is known, being more active than boron, behave differently, the two substances in their application for the formation of the combustion layer of combustible paste on the thin lamellae respectively carrier materials necessitate additional measures.

Thin lamellae with a combustion layer based on phosphorus:

In such lamellae the combustion layer of combustible paste consists preferentially of red phosphorus and a synthetic substance in the weight ratio of 70:30 to 85:15. Because of the relatively high activity of such a combustion layer a combustion layer of such type for avoidance of a too rapidly progressing surface combustion should be provided at least in part with a superficial passivation layer. This passivation layer likewise best consists again of red phosphorus and a synthetic substance, the weight ratio of these two essential components in the passivation layer however amounting to 5:95 to 30:70. As synthetic substance in both cases polyvinyl chloride is used as essentially the most favourable. The combustion layer proper and the passivation layer consequently differ from one another practically only in their percentage composition.

In general the phosphorus-based combustible paste used for coating consists of a combination of a synthetic paste, preferentially a paste of pasting polyvinyl chloride, a plasticizer for polyvinyl chloride, preferably dioctyl phthalate and/or diphenyloctyl phosphate, a suitable dispersing agent, preferably white spirit with a distillation range of 147° to 180° C., and the combustible substance proper, preferably red phosphorus or especially boron. In addition a light metal powder may also be jointly utilised, such as magnesium powder, aluminium powder or a light metal alloy powder. The combustibility of combustible pastes of such type may be still further improved in case of need by addition of oxidizing agents, like inorganic nitrates or metallic oxides, or readily inflammable metal powders, like manganese powder, zirconium powder, cerium powder or boron alloy powder. For obtaining a desired slowly progressing incandescent burning however synthetic paste, combustion substance proper and oxidizing agent or other agents must be present in a definite ratio to one another. Pasting substances with a synthetic paste content of 15 to 30 percent, a content of combustion substance proper of from 60 to 80 percent and a content of oxidizing agents of from 0 to 40% are preferred. The preponderant part of a suitable coating substance for production of the combustion layer of combustible paste on the lamellae thus consists of the actual combustion substance.

In the flares based on phosphorus the coating material used as passivation layer may, as already mentioned, in respect of contents have precisely the same composition as the coating material of combustible paste for formation of the combustion layer, it contains however substantially less of the combustion material proper, which again preferentially involves red phosphorus. For the formation of such a passivation layer therefore again likewise preferred is a coating material, in which the synthetic substance is essentially polyvinyl chloride and the combustion material proper is based on red phosphorus. In contrast to the coating material for the combustion layer of combustible paste the coating material for the passivation layer however contains a lower content of the combustion material proper. The passivation layer accordingly consists preferentially of red phosphorus and a synthetic material, particularly polyvinyl chloride, in the ratio by weight of 50:95 to 30:70.

A preferred coating material for the formation of the combustion layer of combustible paste based on red phosphorus, especially with paper as carrier material, is produced for example as follows:

One adds 25 parts of a plasticizer for polyvinyl chloride based on dioctyl phthalate and a plasticizer for polyvinyl chloride based on diphenyloctyl phosphate to a suitable container and mixes the whole while stirring with an intensive mixer for a duration of about 0.25 hours with 100 parts of a pasting polyvinyl chloride, expediently providing suitable cooling for the elimination of the heat evolved during stirring.

Separately from the production of the polyvinyl chloride ground paste described above 12 parts of white spirit with a boiling range of 147° to 180° C. are likewise poured into a suitable container after which are mixed in portion by portion with continual careful thorough mixing 37.5 parts of red phosphorus. In this care must be taken that absolutely no pockets or lumps of unwetted red phosphorus form.

Polyvinyl chloride ground paste and phosphorus paste are then blended together, the applied mixing ratio moreover being governed by the desired concentration of red phosphorus in the finished paste in each case.

The coating material for formation of the combustion layer of combustible paste on the thin lamellae obtained in the above manner is then applied using a doctor to suitable widths of paper with a weight per unit area of 30 to 35 g/m$^2$, whereupon the layer formed is allowed to gel at a maximum temperature of 180° C. For the formation of a bilaterally coated material the coated paper obtained in the above manner for application of the second coating is run anew through the doctor.

Following this one can apply an appropriate passivation layer under appropriate conditions to the unilaterally or bilaterally coated material.

The data using parts given above relate to parts by weight.

In order that the thin lamellae with the relatively .active combustion layer based on phosphorus and disposed above this the hereon contingent passivation layer be properly and quickly ignitable in the desired manner, circular-sector-shaped thin lamellae of such type furnished unilaterally or bilaterally with a combustion layer of combustible paste and a passivation layer should show an igniter strip either on their inner curved margins turned towards the igniter-destructor unit or on one of their lateral edges. Particularly preferred however are such circular-sector-shaped lamellae, which both on their inner circular margin, that is the circular-sector-shaped notch for the accommodation of the igniter-destructor unit, and also on at least one of their lateral edges show igniter strips lacking a passivation layer.

The igniter strips formed in this manner ensure that the lamellae at discharge from the screen material canister can be ignited via the igniter-destructor unit relatively rapidly and simply, whereas by virtue of the passivation layer—or in general a more passive layer than on the igniter strips—present on their principal surface they then burn more slowly in the desired manner.

The ready-to-use lamellae, that is the lamellae provided with a combustion layer of combustible paste and in case of need a passivation layer, have expediently a weight per unit area of up to approximately 400 g per m$^2$. With lamellae of paper as carrier material this weight per unit area lies preferably between 135 and 400 g per m$^2$. With lamellae of aluminium as carrier material the weight per unit area in ready-to-use condition is preferably likewise 135 to 400 g per m$^2$. Ready-to-use lamellae of plastic or metal-coated plastic as carrier material have weights per unit area of preferably 130 to 200 g per m$^2$. As carrier material for the production of plastic or metal-coated plastic lamellae polyimide foils may be used, which in appropriate instances are vapour-coated with metal.

Thin lamellae with a combustion layer based on boron:

In such lamellae the combustion layer of combustible paste consists preferentially of boron and/or a boron alloy with a boron content of at least 90 percent by weight and of a synthetic substance in the weight ratio likewise of between 70:30 to 85:15. Here again too the synthetic substance is preferentially essentially polyvinyl chloride. The combustible paste may contain besides the above constituents still further additives, for example up to 40 percent by weight of oxidizing constituent and/or active metal powder and/or active metal alloy powder. As oxidizing constituent lead dioxide is especially suitable, whereas as active metal powder and/or active metal alloy powder above all manganese powder, zirconium powder, cerium powder and/or boron alloy powder are suitable.

Since however combustion layers based on boron are normally less active than those based on phosphorus, with thin lamellae with combustion layers of this type no separate passivation layer is generally necessary. In contrast with the combustion layer based on phosphorus however a combustion layer based on boron cannot be easily ignited by means of a suitable igniter-destructor unit. For this reason on lamellae of this kind with a combustion layer based on boron indeed suitable igniter strips must again be provided, which however in contrast to the igniter strips in the lamellae based on phosphorus cannot consist of the combustion layer proper, but consist of a special igniter layer disposed upon the combustion layer in the region of the igniter strip, which can be easily ignited and burns until it has transferred its ignition energy to the combustion layer based on boron situated beneath it. For the formation of suitable igniter strips in the circular-sector-shaped lamellae with a combustion layer of combustible paste of boron and/or boron alloys and of a synthetic substance any substance is thus suitable, which fulfils the requirements set out above. Preferentially these igniter strips in the lamellae based on boron however are formed using the same combustible paste as in the lamellae based on phosphorus, namely by applying a combustible paste, which consists of red phosphorus and a synthetic material in the weight ratio of 70:30 to 85:15, onto the combustion layer of combustible paste based on boron in each case on the edges of the circular-sector-shaped lamellae considered as igniter strips.

The coating pastes necessary for these lamellae based on boron can be prepared in exactly the same way as has already been described for the coating pastes based on phosphorus.

The carrier materials used for the production of lamellae with a combustion layer based on boron and the other data, such as the weight per unit area of the ready-to-use lamellae, are moreover identical with the relevant data for the lamellae with a combustion layer based on phosphorus.

Aside from a filling in accordance with the invention of the interior of the above mentioned first constructional form of the screen material canister in accordance with the invention with combustible thin lamellae as screen material any other known screen material may be used instead, for example a conventional smoke charge in either loose comminuted or more or less strongly compacted form. To such smoke charges belong also the so-called pyrotechnic smoke charges, to which inter alia smoke charges based on red phosphorus also belong. Such smoke charges are discussed for example in TECHNIK UND VERSORGUNG 1970, pages 63 to 68, and indeed particularly on pages 66 and 67. The use of briquetted (trapeziform) bodies of smoke- and flame-producing substances has already been referred to in DE-PS 19 13 790.

The conventional forms, in which pyrotechnic smoke charges find application, have the disadvantage however, that they either burn too rapidly, so that the desired smoke screen does not long persist, burn too slowly, so that the desired smoke screen does not have the requisite density, or they burn at scattered points, so that in general no dense and continuous smoke screen develops or its development takes up too much time.

The invention accordingly has assumed the further task of eliminating the disadvantages inherent in the known smoke charges which are used as screen material and of creating a smoke projectile, which within a few seconds of discharge produces a dense smoke screen, which receives 'top-up' feeding from the base up by a multitude of smoking particles.

This task has now been solved in the above-mentioned first constructional form of the screen material canister of the present projectile in the manner arising out of the corresponding claims, namely in that, the screen material which partly or completely fills the interior of the screen material canister is a single pressed body, which is produced by pressing pellets of a smoke charge based on red phosphorus and a granulate of a smoke charge based on red phosphorus with far-reaching conservation of the integrity of the pellets and the formation from the granulate of a porous structure enveloping the individual pellets.

The above-mentioned screen material represents preferentially a pressed body, which completely fills the interior of the screen material canister.

The respective pressed body thus corresponds largely to the form produced by the respective screen material container including its cover and its base, in its centre only being provided a recess for the accommodation of the rod-shaped igniter-destructor unit, which is co-formed directly during pressing of the present pressed body.

A further, under certain circumstances favourable constructional form of such a projectile consists in this, that the screen material is a pressed body only partly filling the interior of the screen material canister and the remaining part of the interior of the screen material canister is occupied by screen material consisting of combustible thin lamellae of the type already described above. A projectile of such type makes possible for example the realization of a combination effect of a pressed body based on phosphorus and corresponding combustible thin lamellae.

The pellets contained in the pressed body mentioned above and in accordance with the invention have preferentially a diameter of about 11 mm, a height of 6 mm and a weight of about 1 g. The pellets usually consist of red phosphorus, copper oxide powder, magnesium powder and a binding agent. The pellets contained in the pressed body normally possess a higher proportion of binding agent than the granulate contained therein, since in this case the granulate is more plastic and is more easily pressed together with the pellets.

The pellets contained in the pressed body consist preferentially of about 65 to 75 percent by weight of red phosphorus, about 5 to 20 percent by weight of copper oxide powder, about 3 to 5 percent by weight of magnesium powder and about 3 to 10 percent by weight of binding agent.

The granulate contained in the pressed body consists preferentially of about 60 to 70 percent by weight of red phosphorus, about 5 to 20 percent by weight of copper oxide powder, about 3 to 8 percent by weight of magnesium powder and about 5 to 15 percent by weight of binding agent. The binding agent is in each case best an elastomer.

The weight ratio of the pellets and granulate in the pressed body used as screen material preferentially amounts to 8:2 to 7:3.

The essential and preponderating constituent of the respective smoke charges for the production of the pellets and the granulate is red phosphorus. In the consumption by burning of red phosphorus however phosphoric acid arises, which is deposited onto the small part already present on the surface of the still unconsumed phosphorus as a condensate. Thereby access of oxygen from the air is impeded, and extinguishing of the smoke charge results. To the red phosphorus therefore must be added such quantities of oxidizing constituents, for the most part metal oxides, or of metal powders, which react exothermically with the red phosphorus, so that the desired reaction is sustained. As oxidizing constituents are preferably used copper oxide, manganese dioxide or nitrate, and as metal powder magnesium powder is preferentially applied. The applicable smoke charges in question may therefore essentially consist only of phosphorus and magnesium powder and/or copper oxide, a certain content of binding agent being of course indispensable.

As binding agent an elastomer is used both in the production of the pellets as well as in the production of the granulate, preferentially based on chlorinated rubber. The proportion of binding agent in the smoke charge material used for the production of the granulate is as a rule higher than the proportion of binding agent in the smoke charge material employed in the production of the pellets. It is essential in this that the binding agent confers high strength with substantial elasticity on the pellets, so that these on pressing with the granulate are deformable up to a certain limit, without however breaking in the process.

The second, briefly mentioned above, and specified as specially preferred, constructional form for a projectile in accordance with the invention consists herein, that in or on the fastening plate situated in the base of the screen material canister or the base of the screen material canister developed as a fastening plate there is arranged an expelling charge chamber for an expelling charge for discharging screen material present in the screen material canister at ejection of the cover present on the head of the screen material canister, which naturally is also connected with the delayed action fuse assembly. By appropriate constructional precautions care is taken in this version to ensure, that the expelling charge chamber necessary thereto does not stand in actual direct contact with the corresponding parts of the wall of the screen material canister, so that the force developed at firing the expelling charge located in the expelling charge chamber acts essentially as thrust in the direction of the cover of the screen material canister, whereby the screen material present in the screen material canister and arranged on a suitable carrier tray is discharged together with the carrier tray practically via the head of the screen material canister.

The expelling charge chamber necessary to this end is arranged preferentially in the upper side of the fastening plate or in the base of the screen material canister developed as a fastening plate and open towards the interior of the screen material canister. The upper surface of the fastening plate or of the base developed as fastening plate is thus developed as simply recessed in the form of a shallow piston. The rim of the piston thus formed ensures, that the force generated when the expelling charge is fired is not able to act directly against the wall of the screen material canister.

The screen material in the above particularly preferred additional constructional version of the projectile in accordance with the invention is arranged above the expelling charge chamber on a screen material carrier of at least one screen material carrier tray, this screen material carrier being inserted in practically tilt-free alignment in the screen material canister. The screen material carrier tray and the fastening plate or the base of the screen material canister developed as fastening plate are in this connection preferably so developed, that the expelling charge chamber, as already stated, has no direct contact with the surrounding wall of the screen material canister. The above-mentioned practically tilt-free insertion of the screen material carrier, and in consequence also of the screen material carrier tray, in the screen material canister and the necessity of avoidance of direct contact of the expelling charge chamber with the surrounding wall of the screen material canister can be achieved by various means or a combination of such means. The screen material carrier tray contains for this purpose at its outer margin preferentially at least one packing ring giving a gastight seal against the wall of the screen material canister, and shows in particular two such packing rings. The material for these packing rings may be likewise once again nitrile rubber. The screen material carrier accordingly has preferentially the form of a shallow piston open towards the base of the screen material canister, the lower outer edge of the screen material carrier tray best engaging in the upper outer edge of the fastening plate or the base of screen material canister developed as fastening plate. By this combination a proper closure of the expelling charge chamber towards the surrounding wall of the screen material canister is achieved. The packing rings present in the outer margin of the screen material carrier tray ensure a gastight seal of the charge chamber towards the screen material containing space of the screen material canister, make possible a tilt-free insertion of the screen material carrier tray in the screen material canister and in addition ensure compensation for tolerance between the screen material carrier tray and the wall of the screen material canister. Without these measures the screen material canister after firing of the expelling charge could be burst open laterally, so that the desired clean discharge of the screen material via the head of the screen material canister would not occur.

The screen material carrier in the just described especially preferred constructional version of the projectile in accordance with the invention consists of a screen material carrier tray, a central column disposed thereon and reaching practically to the cover of the screen material canister and at the upper end of the central column a cover plate adapted to the inner diameter of the screen material canister.

The cover plate of the screen material carrier shows in the region of its outer edge a ring of bred holes, which during the flight of the screen material filled screen material carrier ensures adequate stabilisation and at the same time has the effect, that the screen material is practically blown out through these and is thus properly distributed.

As screen material in the just described further preferred constructional version of the projectile in accordance with the invention there is on the screen material carrier parallel to the long axis of the screen material canister arranged preferentially chaff. At best here several packages of chaff are arranged one above the other on the screen material carrier, the individual packages being separated from one another in each case by separation disks at right angles to the central axis of the screen material canister. Instead of complete separation disks this function may also be fulfilled by disk segments which in each case make up a complete disk. The separation disks may consist for example of cardboard or other suitable materials.

The individual chaff packages have the form of circular disks, the outer diameter of which corresponds to the inner diameter of the screen material canister. Centrally in these packages is inserted a tube of cardboard or aluminium, by which they may be easily and cleanly stacked on the central column of the screen material carrier. The chaff packages are usually enveloped in foil, which on introducing individual packages into the screen material canister is cut through in at least three places distributed at equal distances around the circumference, so that the envelope falls away at discharge of the chaff.

The mode of functioning of the present projectile is as follows:

The propellant charge present in the contact head is fired via the contact rings and primer capsule, whereby the projectile with simultaneous ignition of the delayed action fuse assembly is launched from the cup discharger. Then after the lapse of the requisite time lag the delayed action fuse assembly fires the igniter-destructor charge present in the screen material canister or the expelling charge. As a result there is then brought about either bursting of the wall of the screen material canister with simultaneous ignition of the screen material through the igniter-destructor charge or the screen material present in the screen material canister on a suitable screen material carrier is discharged, when the cover of the screen material canister is blown off, via the head of the screen material canister. In both processes there is obtained a proper and uniform distribution of the screen material to the desired extent and at the desired height.

The invention will be elucidated in greater detail by means of the drawings.

These show

Figure 2:
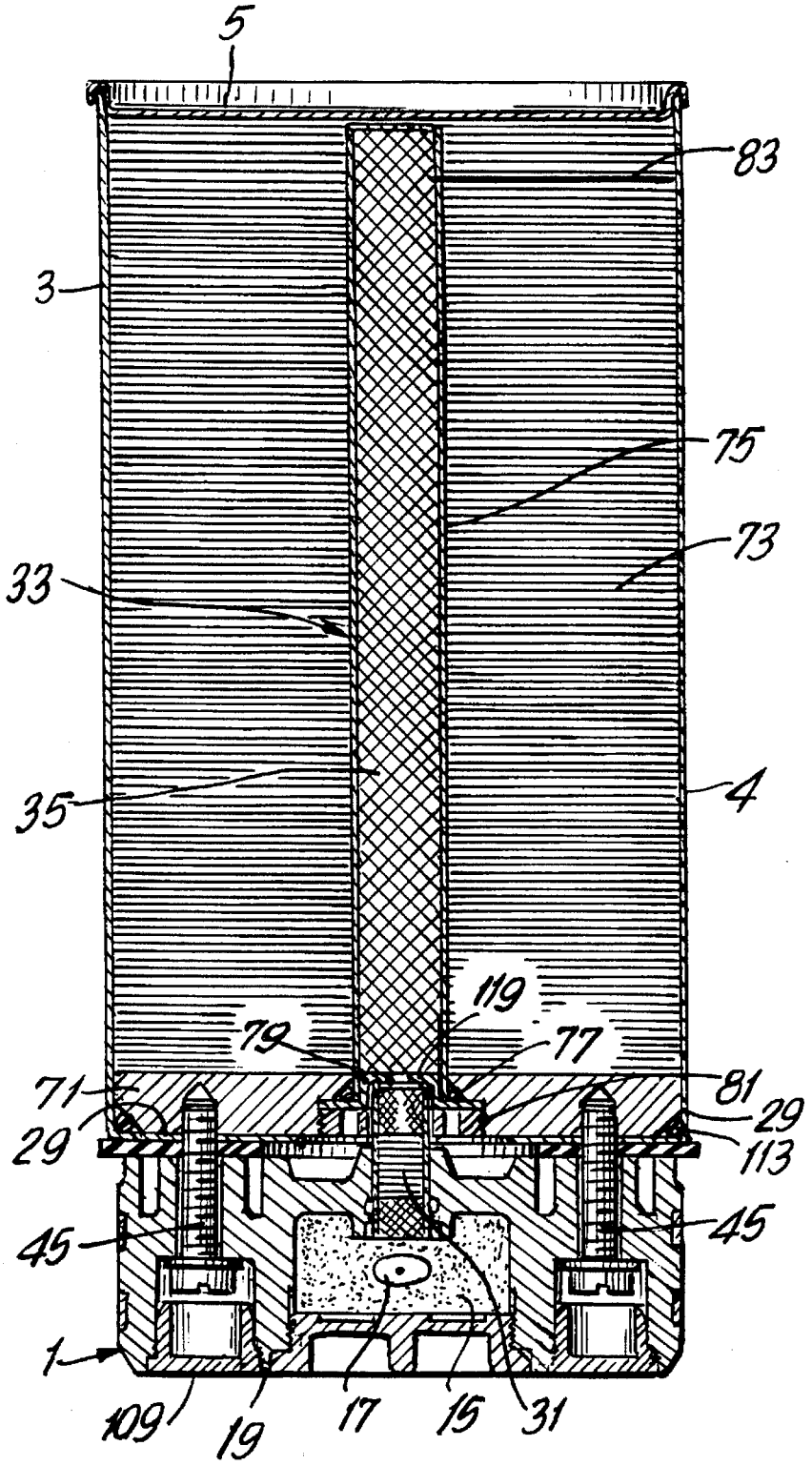
Figure 3:
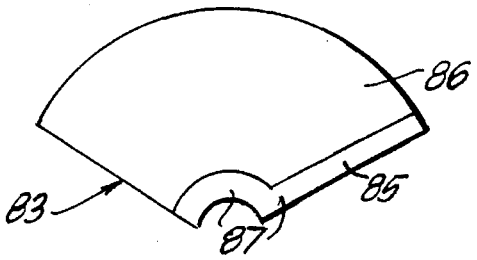
Figure 4:
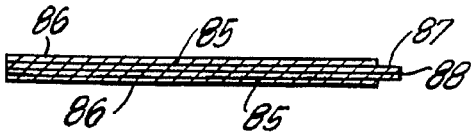
Figure 6:
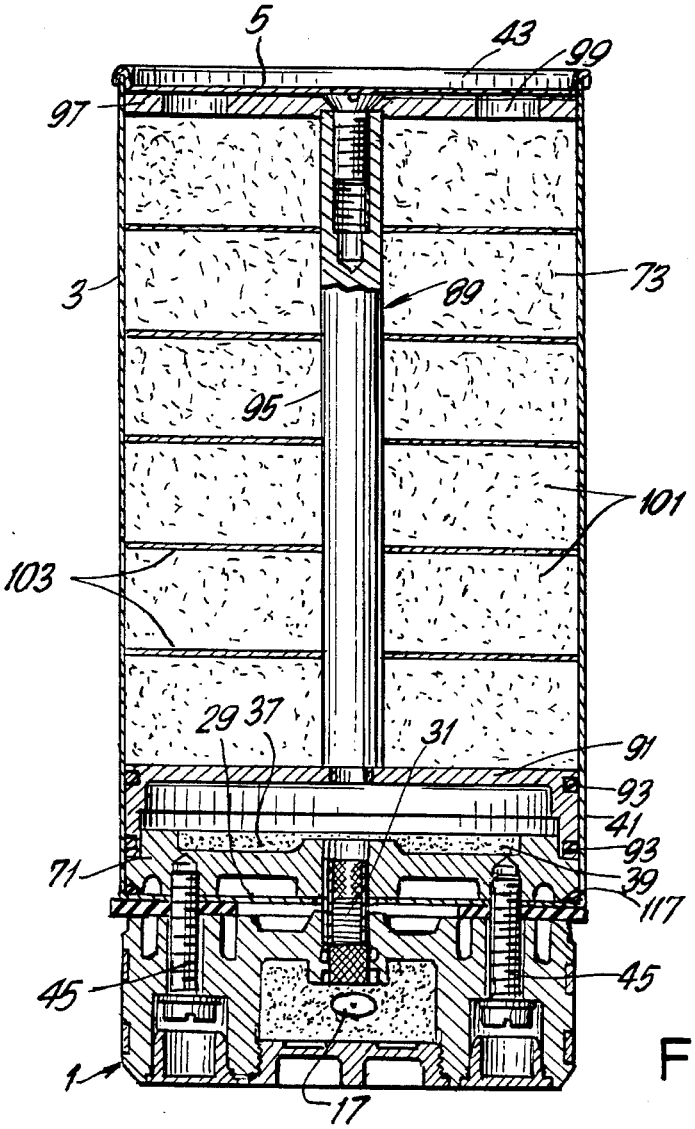
Figure 5:
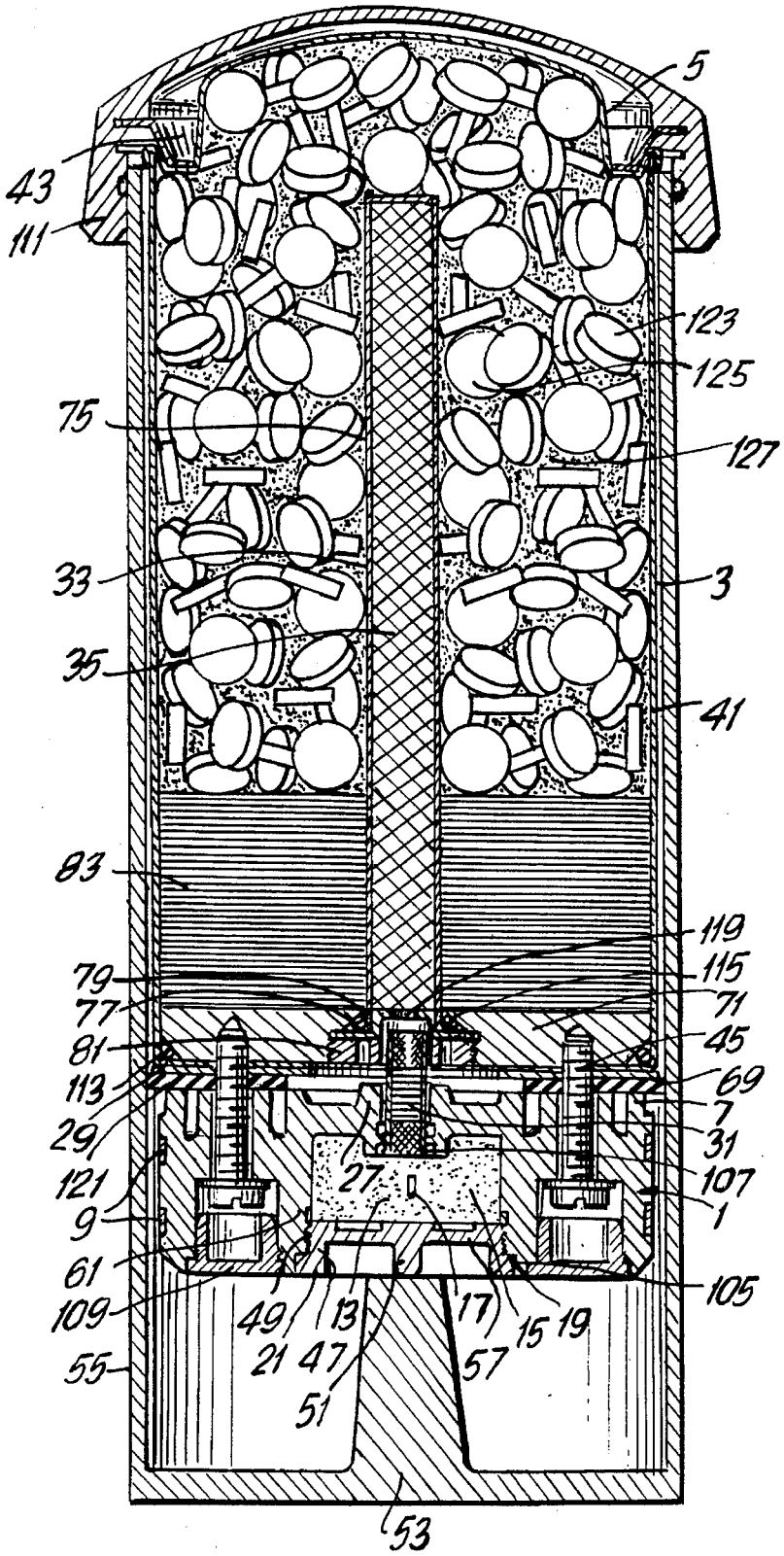

FIG. 1: a vertical section through a projectile in accordance with the invention without special development of the interior of the screen material canister;

FIG. 2: a vertical section through a projectile in accordance with the invention in conformity with FIG. 1, this section in comparison with the section in FIG. 1 however is rotated through 90° and the interior of the screen material canister filled with thin circular-sector-shaped lamellae as screen material and provided with an igniter-destructor unit;

FIG. 3: a plan view of one of the circular-sector-shaped lamellae used as in FIG. 2 in the form of a circular sector with an angle of 120°;

FIG. 4: a radial section through a circular-sector-shaped lamellae in accordance with FIG. 3;

FIG. 5: a vertical section through a projectile in accordance with the invention, there being present in the interior of the screen material canister thin, circular-sector-shaped lamellae as screen material and in addition a pressed body of pellets and granulate based on a conventional phosphorus smoke charge as screen material;

FIG. 6: a vertical section through a projectile in accordance with the invention in conformity with FIG. 1; in comparison with the section in FIG. 1 however this section is rotated through 90° and the interior of the screen material canister so developed, that it contains an expelling charge chamber and a screen material carrier consisting of a screen material carrier tray, central column and cover plate with perforations (bored holes), in which between suitable separation disks the packages of chaff are arranged one at a time.

The design of the projectile in accordance with FIGS. 1, 2, 5 and 6 is thus, in respect of its essential structural elements, namely the screen material canister and the contact head connected to it by means of an elastic sealing washer, always the same.

In detail FIG. 1 shows a contact head 1 with a charge chamber 13, in which in the operationally ready condition is present a propellant charge, in which a primer capsule 17 is embedded. The charge chamber 13 is sealed at the bottom part 19 of the contact head 1 with a screw cover 21. At the cover edge 47 of the screw cover 21 a suitable thread 49 is arranged. In the bottom of the screw cover 21 are present window-shaped preset breaking points. The screw cover 21 shows, developed in the form of a cross-piece, an abutment 51 for a spacer 53 of a cup discharger 55. On the cover edge 47 of the screw cover 21 is arranged a packing ring 105 for this screw cover 21. In the head section 27 of the contact head 1 is arranged a delayed action fuse assembly 31, which connects the charge chamber 13 with the interior of a screen material canister 3. The delayed action fuse assembly 31 is screwed into the head section 27 of the contact head 1 by way of a threaded tube 107. In the casing 61 of the charge chamber 13 are present ports 23, which connect the primer capsule 17 via wire leads 67, which are sealed with a sealing agent 25, and via connecting pins 63, which are arranged in a cross-piece 65, which is situated in the inner space 59 between the casing 61 of the charge chamber 13 and an outer casing 57 of the contact head, with contact rings 9 arranged in the outer casing 7 of the contact head 1. Thus the connecting pins 63 together with the wire leads 67 form firing leads 11 between the contact rings and the primer capsule. The contact head 1 together with the screw cover 21 with incorporation of its other structural elements is produced by injection moulding in polystyrene.

Between the head section 27 and the base 29 of the screen material canister 3 is arranged an elastic sealing washer 69 (in the present case of nitrile rubber). The elastic sealing washer 69 ensures a tight seal of the projectile in the cup discharger 55. In the base 29 of the screen material canister 3 there is arranged in addition a fastening plate (not-shown) or this base 29 of the screen material canister 3 is reinforced to form a fastening plate (likewise not shown). Furthermore there are present in the contact head 1 suitable drilled holes (not shown), through which the base of the screen material canister 29 can be firmly connected by means of bolts (not shown) with the contact head 1. The respective drilled holes for the bolts are sealed on the basal part 19 of the contact head 1 by suitable cover caps of plastic (not shown). The structural elements just discussed ensure a proper connection of the contact head 1 with the screen material canister 3.

At the head 43 of the screen material canister 3 is arranged a cover 5 by means of a suitable flange. The projectile is tightly fitted in the cup discharger 55 by means of a cover cap 110. A cover cap of conventional design is here involved.

Screen material canister 3 and cover 5 of this screen material canister inclusive of the fastening plate which is not shown or the reinforced base developed as fastening plate (likewise not shown) consist of the present preferred material, namely of aluminium. The wall thickness of the screen material canister 3 and the material thickness of the cover 5 is for example about 0.25 mm.

FIG. 2 shows in detail the same structural elements as in FIG. 1, which are also in each case designated by the same number symbols, it makes visible however by virtue of the section being rotated through 90° in relation to the section in FIG. 1 still further structural elements and contains moreover in the interior of the screen material canister 3 further structural elements, which are not specified in FIG. 1 or are not present. A separate elucidation of the number symbols common to both figures will therefore be dispensed with.

In the contact head 1 in accordance with FIG. 2 bolts 45 can be seen, the drilled holes of which are closed flush with the base 19 of the contact head 1 by the cover caps 109. The bolts 45 insert into a fastening plate 71 arranged in the base 29 of the screen material canister 3 and thus connect the screen material canister 3 firmly with the contact head 1. The fastening plate 71 is tightly fitted in the base 29 of the screen material canister 3 by means of an O-ring 113.

In the interior of the screen material canister 3 there is present inserted in the fastening plate 71 an igniter-destructor unit 33. This igniter-destructor unit 33 consists of a tube 75, which contains an igniter-destructor charge 35 and which shows at its end situated in the fastening plate 71 an edge flanged towards the inside 77, which engages in a cover plate 79, via which the tube 75 is tightly fixed by means of a lock screw 81 and a ring packing in the fastening plate 71 on the base 29 of the screen material canister 3. The drilled hole in the cover plate 79 is covered with stuck-on foil, preferentially tin foil, and this closes off the igniter-destructor charge 35 from the delayed action fuse assembly 31. From the tube 75 of the igniter-destructor unit 33 and reaching to the wall 41 of the screen material canister 3 is disposed in the interior of the screen material canister 3 a screen material 73, in this case the screen material consists of circular-sector-shaped lamellae 83 in the form of a circular sector with an angle of 120°. These circular-sector-shaped lamellae 83 are thus disposed in a layered arrangement around the tube 75 of the igniter-destructor unit. The tube 75 of the igniter-destructor unit 33 consists in the constructional form shown just as does the screen material canister and its cover 5 as well as its fastening plate 71 of the material preferred for the present invention, namely aluminium. Tube 75, screen material canister 3 and cover 5 have in each case a wall thickness of about 0.25 mm. FIG. 2 thus describes one of the two especially preferred projectiles in accordance with the invention, namely a projectile for combustible thin lamellae as screen material, which is suitable above all for the production of an infrared radiating decoy cloud for infrared-responsive target-homing missiles.

FIG. 3 shows a circular-sector-shaped lamellae 83, which has the form of a circular sector with an angle of 120°. By 87 are designated appropriate igniter strips, which exhibit a combustion layer 85 of combustible paste. This combustion layer 85 of combustible paste covers the entire surface of the lamellae 83. Above this combustion layer 85 of combustible paste with the exception of the igniter strips is arranged a passivation layer 86.

FIG. 4 shows in detail a radial section through a lamellae 83 corresponding to FIG. 3, the carrier material 88 for this lamellae being bilaterally coated, each surface showing the combustion layer 85 of combustible paste and the overlying passivation layer 86. The igniter strip lying against the tube 75 of the igniter-destructor unit 33 in the ready assembled projectile, which delineates a circular-sector-shaped cut-out, is designated by 87.

In the circular-sector-shaped lamellae shown in FIGS. 3 and 4 the combustion layer of combustible paste is based preferentially on phosphorus and the same applies also to the passivation layer 86 necessary in practice in this case. The igniter strips 87 are therefore here formed automatically by the sufficiently active combustion layer proper of combustible paste based on phosphorus by not coating with the passivation layer.

The circular-sector-shaped lamellae, of which the combustion layer 85 of combustible paste is based in particular on boron, differ from the lamellae shown in FIGS. 3 and 4 by the combustion layer 85 being of different type, in lacking the passivation layer 86 and in the fact, that in these the igniter strip 87 consists of a special combustion layer (igniter layer) applied over the combustion layer 85 of combustible paste based on boron, which is able to ignite the underlying combustion layer based on boron and which preferentially has exactly the same composition as the combustion layer of combustible paste based on phosphorus.

The projectile represented in FIG. 5 corresponds down to the possible additional presence of a so-called spacer compensating disk between the elastic sealing washer at the contact head and the screen material canister, to the different type of filling of the interior of the screen material container, namely an only partial filling with circular-sector-shaped lamellae and the essential filling with the pressed body in accordance with the invention of pellets and a granulate in each case of a smoke charge based on red phosphorus, and the additional presence of a convex formed cover and a cover cap for the projectile in the cup discharger of FIG. 2, the equivalent structural elements in each case being also designated by the same reference numbers. In addition in FIG. 5 there is also present a cup discharger, which corresponds to the cup discharger of FIG. 1 and is thus provided with the same reference number.

Between the head section 27 of the screen material canister 3 and the elastic sealing washer 69 (in the present case of nitrile rubber) present at the head section 27 of the contact head 1 there is in comparison with FIGS. 1 and 2 additionally arranged a massive spacer compensating disk 121, the outer diameter of which is smaller than the outer diameter of the elastic sealing washer 69 and is of such size, that by it a flanging of the elastic sealing washer 69 is retained in the annular clearance between the wall 41 of the screen material canister 3 and the inner wall of the cup discharger 55. The elastic sealing washer 69 together with the massive spacer compensating disk 121 ensures a tight seal of the projectile 3 in the cup discharger 55. At the head 43 of the screen material canister 3 there is arranged once again via a suitable flange a cover 5, which in the present case is produced in domed form for better utilization of space. Stretching from the tube 75 of the igniter-destructor unit 33 to the wall 41 of the screen material canister 3 there is arranged in the bottom part of the interior of the screen material canister 3 a screen material of combustible thin lamellae 83, in which preferentially circular-sector-shaped lamellae are involved, which have the form of a circular sector with an angle of about 120°.

In the interior of the screen material canister 3 in accordance with FIG. 5 there is additionally present the single pressed body regarded in the present case as the essential screen material, which is produced by pressing pellets 125 of a smoke charge based on red phosphorus and a granulate 127 of a smoke charge based on red phosphorus with thorough-going maintenance of the integrity of the pellets 125 and the formation from the granulate of a porous structure enveloping the pellets 127.

The essential feature of the modified first constructional form of the present projectile thus consists in the special structure of the pressed body 123 made up of the pellets 125 and the granulate 127. On firing the projectile besides ignition and scattering of the combustible lamellae 83 possibly present within by means of the igniter-destructor unit 33 the pressed body 123 is also ignited and fragmented, the wall 41 of the screen material canister being also destroyed at the same time. At destruction the granulate of the pressed body becomes pulverized and immediately ignites. As a result of the then developing 'fire blitz' a reliable and persistent ignition of the pellets is achieved. There then arises at the same time a very dense smoke cloud over the object to be protected, which conceals this from a possible aerial attacker. The burning pellets falling to earth raise a smoke screen, which they feed from below by their further combustion. It is precisely the special construction of the pressed body 123 made up of the pellets 125 and the granulate 127 which ensures, that immediately after firing a dense and long-persistent smoke screen is formed, which is maintained for a longer period by the slow burning out of the pellets.

The application of the present pressed body is obviously not absolutely restricted to a special projectile of the type here described. It can on the contrary be employed wherever, as a result of suitable provisions, a proper destruction of the pressed body with simultaneous ignition of its constituents is ensured.

For the production of a pressed body in accordance with the invention one proceeds for example as follows:

For production of the pellets 69.8 percent of weight of red phosphorus, 19.4 percent by weight of copper oxide, 4.8 percent by weight of magnesium powder and 6.0 percent by weight of an elastomer binding agent based on chlorinated rubber which has been plasticized in a solvent are mixed thoroughly with one another, whereupon the mixture obtained is pelleted in the usual manner to pellets weighing approximately 1 g with a diameter of 11 mm and a height of 6 mm.

For production of the required granulate 65.7 percent by weight of red phosphorus, 18.2 percent by weight of copper oxide, 4.5 percent by weight of magnesium powder and 11.6 percent by weight of an elastomer binding agent based on chlorinated rubber and plasticized in solvent are granulated in the usual manner to produce a granulate with an average grain size of about 0.5–2 mm.

Thereupon 420 parts by weight of the pellets so obtained and 160 parts of the granulate produced are mixed with one another and then using a pressure, which does not destroy the integrity of the pellets but leads to the production of a pressed body, in which the pellets are embedded in a porous matrix of the smoke charge, the mixture is pressure moulded to form a pressed body, in a moulding tool, which corresponds exactly to the interior of the screen material canister.

FIG. 6 represents the second especially preferred constructional version of the present projectile in accordance with the invention, namely a projectile which is particularly well suited to the firing of chaff.

The numerical symbols have here once more the same significance as in FIGS. 1 and 2 already elucidated. Like FIG. 2, FIG. 6 also is a vertical section which in relation to FIG. 1 has been rotated through 90°. The sectional plane of FIG. 6 thus corresponds to the sectional plane of FIG. 2. The contact head in FIG. 6 accordingly is fully identical with the contact head in accordance with FIG. 1 and in accordance with FIG. 2. Elucidation in detail of this contact head may therefore be omitted. The same applies also to the screen material canister 3 as well as the cover 5 present thereon. Only the fastening plate 71 in the base 29 of the screen material canister is modified in comparison with FIGS. 1 and 2. In addition too of course the contents of the screen material canister itself by virtue of the different function of the screen material canister in conformity with FIG. 6 are differently organised than in the projectile in accordance with FIG. 2.

The fastening plate 71 present in the base 29 of the screen material canister 3 depicted is developed as an expelling charge chamber 37 open on its upper surface towards the interior of the screen material canister 3, in which in the operationally ready condition is located an expelling charge 39. The fastening plate 71 has therefore the form of an open shallow piston facing towards the interior of the screen material canister. The expelling charge 39 located in the expelling charge chamber 37 is in communication with the delayed action fuse assembly 31. The exterior and the upper edge of the fastening plate 71 turned towards the wall 41 of the screen material canister shows an annular groove.

In the interior of the screen material canister 3 over the expelling charge chamber 37 of the fastening plate 71 there is arranged a screen material carrier 89. The screen material carrier 89 consists of a screen material carrier tray 91, which is inserted in the screen material canister by means of the packing rings 93. These packing rings once more consist preferentially of nitrile rubber. The screen material carrier tray 91 is connected via a central column 95 with a cover plate 97, in which is found a ring of bred holes 99. The screen material carrier consists accordingly in the constructional version shown of these three named essential structural elements. Along the central column 95 of the screen material carrier 89 are arranged separation disks 103 extending over the entire cross section of the screen material canister 3, by which the individual packages of chaff are separated from one another. The chaff 101 is here arranged in each of the spaces created by the separation disks 103 in bundles and parallel to the long axis of the projectile and hence running parallel to the central column 95. The chaff may consist of metallized plastic threads, glass threads or metal filaments.

On firing the expelling charge 39 located in the expelling charge chamber 37 via the delayed action fuse assembly 31 the chaff filled screen material carrier 89 is discharged from the screen material canister 3 through ejection of the cover 5 situated on the head 43 of the screen material canister 3, the cover plate 97 present on the screen material carrier 89 together with the perforations (bored holes) 99 present in it providing for good stabilisation and proper distribution of the chaff present in the screen material carrier. The layers of chaff present on the separation disks 103 flutter through this laterally from the screen material carrier 89.

The preferred construction material for the screen material canister 3 is in the equipment shown in FIG. 6 likewise once more aluminium. The same applies also to the cover 5 of the screen material canister 3 as well as to the fastening plate 71. The wall thickness of the screen material canister is here again also about 0.25 mm. The screen material carrier in its essential structural elements is also preferentially fabricated in aluminium.

The projectiles shown in FIG. 2 (including FIG. 3 and FIG. 4), in FIG. 5 as well as in FIG. 6, as already mentioned, are suited in particular to the firing of thin lamellae (flares), incendiary and smoke compositions based on red phosphorus, if need be in combination with thin lamellae, or of chaff (fine metallic wires). The projectiles in question could in place of these however just as well be filled with other screen materials, and for this purpose the projectile already shown in FIG. 1 in its basic conception with suitable adaptation of the internal arrangement of the screen material canister to the conditions in the particular case may then be used with equal success. Independently of this in place of the present contact head another contact head may also be used, so that the respective screen material canisters in accordance with the invention together with their internal furnishing and their respective screen material may also be combined with conventional contact heads.

We claim:

1. A projectile consisting of a contact head having a box-shaped centrally disposed interior charge chamber containing a propellant charge, ports for firing leads and an outer casing therearound, said contact head having connected thereto a screen material canister (3) consisting of a drawn aluminum container having a base (29), a plate (71) located in the bottom of the canister for fastening the canister to the contact head, and aluminum container (3) being composed of wall (41) being closed at its top (43) by flanging with an aluminum cover (5), said canister containing a screen material, the outer casing of the contact head having contact rings arranged thereon which are connected via firing leads to a primer capsule, said charge chamber being gas-tight by virtue of a screw cover at its base and at the firing lead ports by virtue of a sealing agent, the screw cover having rupture discs thereon for the escape of the propellant gas upon ignition, the canister having therein a centrally disposed tube-like igniter-destructor unit with an igniter-destructor charge for igniting the screen material contained in the canister and fragmenting the canister wall, the contact head and canister being securely connected to one another by bolts and having disposed between the two, a delayed action fuse assembly which communicates with the igniter-destructor unit and the interior charge chamber.

2. The projectile of claim 1 wherein the screen material (73) consists of thin combustible lamellae (83) which are circular shaped and disposed radially in the canister (3) around the igniter-destructor unit (33) and wherein the lamellae (83) consist of a carrier material (88) with at a least unilaterally applied, slow-burning combustion layer (85) of combustible plaste.

3. The projectile of claim 2 wherein the circular-sector-shaped lamellae (83) have the form of a circular sector with an angle of about 120°.

4. The projectile of claim 1 wherein the screen material (73) consists of thin combustible lamellae (83) which are circular shaped and are disposed radially in the canister (3) around the igniter-destructor unit (33) and wherein the lamellae (83) consist of a carrier material (88) with bilaterally applied combustion layers (85) of combustible paste.

5. The projectile of claim 2 or 4 wherein the combustion layer (85) present on the lamellae (83) consists of a combustible paste of red phosphorus and a synthetic material in the weight ratio of 70:30 to 85:15 or boron or boron alloys with a boron content of at least 90 percent by weight and of a synthetic substance in the weight ratio of 70:30 up to 85:15.

6. The projectile of claim 5 wherein the combustible paste of boron or boron alloys and the synthetic substance contains in addition up to 40 percent by weight of an oxidizing constituent, active metal powder, or active metal alloy powder.

7. The projectile of claim 6 wherein the combustible paste of boron and a synthetic substance contains lead dioxide as the oxidizing constituent.

8. A projectile consisting of a contact head having a box-shaped centrally disposed interior charge chamber containing a propellant charge, ports for firing leads and an outer casing therearound, said contact head having connected thereto a screen material canister (3) consisting of a drawn aluminum container having a base (29), a plate (71) located in the bottom of the canister for fastening the canister to the contact head, and aluminum containers (3) being composed of wall (41) which is closed at its top (43) by flanging with an aluminum cover (5), said canister containing a screen material, the outer casing of the contact head having contact rings arranged thereon which are connected via firing leads to a primer capsule, said charge chamber being, gas-tight by virtue of a screw cover at its base and at the firing lead ports by virtue of a sealing agent, for gas-tight closure thereof, the screw cover having rupture discs thereon for the escape of the propellant gas upon ignition, the contact head and canister being securely connected to one another by fastening plate (71), said plate (71) having a chamber therein for containing an expelling charge, said plate having disposed therein, a delayed action fuse assembly which communicates with the contact head and the expelling charge chamber, said expelling charge chamber being shaped so that upon explosion of the charge therein, the forces generated are directed against the screen material and in turn, the cover of the canister which breaks away thus releasing the screen material.

9. The projectile of claim 8 wherein the expelling charge chamber has an opening facing toward the interior of the screen material canister.

10. The projectile of claim 8 or 9 wherein the screen material (73) is arranged on a screen material carrier (89) composed of at least one screen material carrier tray (91) arranged above the expelling charge chamber (37) which is kept in tilt-free alignment in the screen material canister (3).

11. The projectile of claim 8 or 9 wherein the screen material carrier tray (91) and the fastening plate (71) are designed so that the expelling charge chamber (37) has no direct contact with the surrounding walls (41) of the screen material canister (3).

12. The projectile of claim 11 wherein the screen material carrier tray (91) has a packing ring (93) about its outer edge to produce gas-tight contact with wall (41) of canister (3).

13. The projectile of claim 12 wherein two packing rings (93) are present.

14. The projectile of claim 11 wherein tray (91) is in the form of a flat-topped piston, the top of which is exposed to the expelling charge chamber.

15. The projectile of claim 10 wherein the lower outer edge of the screen material carrier tray (91) engages the upper outer edge of fastening plate (71).

16. The projectile of claim wherein the screen material carrier (89) consists of a screen material carrier tray (91), a central column (95) arranged thereon reaching almost to the cover (5) of the screen material canister (3) and a cover plate (97) situated at the upper end of the central column and adapted to the anterior diameter of the screen material canister (3).

17. The projectile of claim 16 wherein cover (97) of screen material carrier (89) has a series of holes therein (99) about the rim thereof.

18. The projectile of claim 10 wherein chaff (101) is arranged on the screen material carrier (89) parallel to the long axis of the screen material canister (3).

19. The projectile of claim 18 wherein several packages of chaff (101) are arranged one above the other on the screen material carrier (89).

20. The projectile of claim 19 wherein the individual packages of chaff (101) are separated from one another by perpendicular separation disks (103) in each case extending through to the central axis of the screen material canister (3).

21. A projectile consisting of a contact head having a box-shaped centrally disposed interior charge chamber containing a propellant charge, ports for firing leads and an outer casing therearound, said contact head having connected thereto a screen material canister (3) consisting of a drawn aluminum container having a base (29), a plate (71) located in the bottom of the canister for fastening the canister to the contact head, and said aluminum container (3) being composed of wall (41) being closed at its top (43) by flanging with an aluminum cover (5), said canister containing a screen material, the outer casing of the contact had having contact rings arranged thereon which are connected via firing leads to a primer capsule, said charge chamber being gas-tight by virtue of a screw cover at its base and at the firing lead ports by virtue of a sealing agent, the screw cover having rupture discs thereon for the escape of the propellant gas upon ignition, the canister having therein a centrally disposed tube-like igniter-destructor unit with an igniter-destructor charge for igniting the screen material contained in the canister and fragmenting the canister wall, the contact head and canister being securely connected to one another by bolts and having disposed between the two, a delayed action fuse assembly which communicates with the igniter-destructor unit and the interior charge chamber;

wherein the screen material (73) consists of thin combustible lamellae (83) which are circular-shaped and are disposed radially in the canister (3) around the igniter-destructor unit (33) and wherein the lamellae (83) consist of a carrier material (88) with bilaterally applied combustion layers (85) of combustible paste;

wherein the combustion layer (85) present on the lamellae (83) consists of a combustible paste of red phosphorus and a synthetic material having a weight ratio of 70:30 to 85:15 or boron or boron alloys with a boron content of at least 90 percent by weight and of a synthetic substance having a weight ratio of 70:30 up to 85:15; and wherein the combustion layer (85) of combustible paste present on the lamellae (83) is provided at least in part with a superficial passivation coat (86).

22. The projectile of claim 21 wherein the passivation coat (86) consists of red phosphorus and a synthetic substance in the weight ratio of 5:95 to 30:70.

23. A projectile consisting of a contact head having a box-shaped centrally disposed interior charge chamber containing a propellant charge, ports for firing leads and an outer casing therearound, said contact head having connected thereto a screen material canister (3) consisting of a drawn aluminum container having a base (29), a plate (71) located in the bottom of the canister for fastening the canister to the contact head, and the aluminum container (3) being composed of a wall (41) being closed at its top (43) by flanging with an aluminum cover (5), said canister containing a screen material, the outer casing of the contact head having contact rings arranged thereon with are connected via firing leads to a primer capsule, said charge chamber being gas-tight by virtue of a screw cover at its base and at the firing lead ports by virtue of a sealing agent, the screw cover having rupture discs thereon for the escape of the propellant gas upon ignition, the canister having therein a centrally disposed tube-like igniter-destructor unit with an igniter-destructor charge for igniting the screen material contained in the canister and fragmenting the canister wall, the contact head and canister being securely connected to one another by bolts and having disposed between the two, a delayed action fuse assembly which communicates with the igniter-destructor unit and the interior charge chamber;

wherein the screen material (73) consists of thin combustible lamellae (83) which are circular-shaped and are disposed radially in the canister (3) around the igniter-destructor unit (33) and wherein the lamellae (83) consist of a carrier material ((88) with bilaterally applied combustion layers (85) of combustible paste, wherein the combustion layer (85) present on the lamellae (83) consists of a combustible paste of red phosphorus and a synthetic material having a weight ratio of 70:30 to 85:15 or boron or boron alloys with a boron content of at least 90 percent by weight and of a synthetic substance having a weight ration of 70:30 up to 85:15;

wherein the combustible paste of boron or boron alloys and the synthetic substance contain in addition up to 40 percent by weight of an oxidizing constituent, active metal powder or active metal alloy powder; and wherein the combustible paste of boron and a synthetic substance contain as the active metal powder or active metal alloy powder, manganese powder, zirconium powder, cerium powder, or boron alloy powder.

* * * * *